United States Patent [19]

McKown

[11] Patent Number: 4,909,507

[45] Date of Patent: Mar. 20, 1990

[54] POCKET REDUCER FOR A POCKET BILLIARD TABLE

[76] Inventor: Robert R. McKown, R.R. #1, Box 190, Brimfield, Ill. 61517

[21] Appl. No.: 279,499

[22] Filed: Dec. 5, 1988

[51] Int. Cl.[4] ..... A63B 15/00

[52] U.S. Cl. ..... 273/12; 273/14

[58] Field of Search ..... 273/12, 14, 4, 3 R, 273/4 A, 57, 7, 9

[56] References Cited

U.S. PATENT DOCUMENTS

| | | | |
|---|---|---|---|
| 869,718 | 10/1907 | Knudson | 273/12 |
| 1,539,192 | 5/1925 | Jaeger | 273/12 |
| 1,627,967 | 5/1927 | Hamblin, Jr. | 273/12 |
| 3,061,308 | 3/1961 | Jobson | 273/14 |
| 3,733,072 | 5/1973 | Neilsen | 273/12 |
| 3,881,725 | 5/1975 | Rubalcava | 273/12 |
| 4,010,949 | 3/1977 | Lee | 273/4 A |
| 4,095,786 | 6/1978 | Foley | 273/4 A |
| 4,318,543 | 3/1982 | Vollendorf | 273/4 A |

*Primary Examiner*—T. Brown

*Attorney, Agent, or Firm*—Sixbey, Friedman, Leedom & Ferguson

[57] ABSTRACT

A pocket billiard table is quickly and easily converted to a snooker table by a removable pocket reducer. The pocket reducer includes a pair of rail assembly extenders 20, 22 substantially identical in cross section to a permanent rail assembly 18 extending about the periphery of a playing field 16. An elongate flexible strap 30 interconnects the rail assembly extenders 20, 22 and conforms to the interior wall of the pocket. Further, end portions 32, 34 of the strap extend below the rail assembly extenders 20, 22 and contact the edge of the playing field 16 to inhibit the extenders from being displaced onto the playing field 16. A leaf spring 38 arcuately connects the rail assembly extenders 20, 22 and biases the rail assembly extenders 20, 22 against the permanent rail assembly 18 to aid in maintaining the rail assembly extenders 20, 22 in their desired position.

5 Claims, 1 Drawing Sheet

Fig. 1
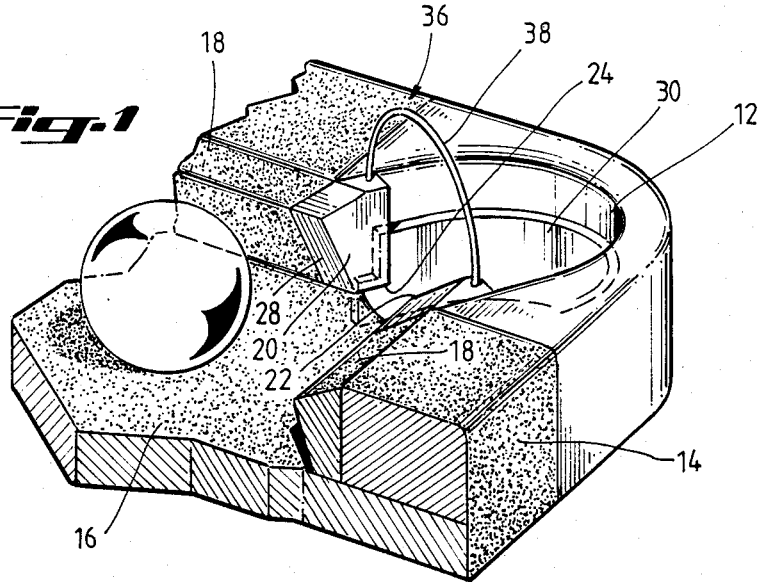
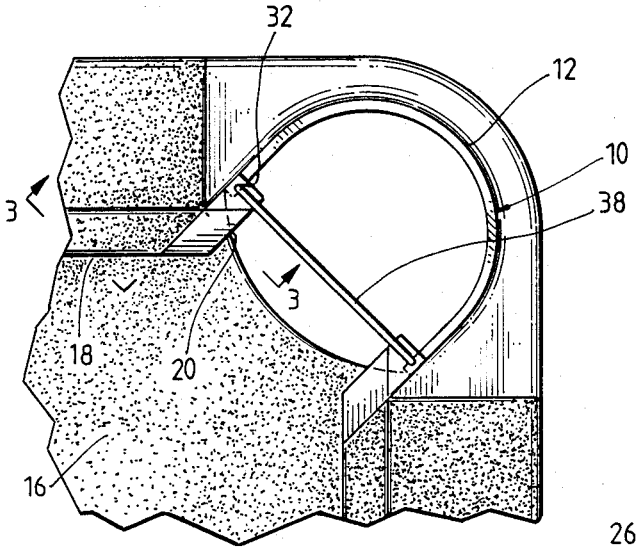
Fig. 2
Fig. 3
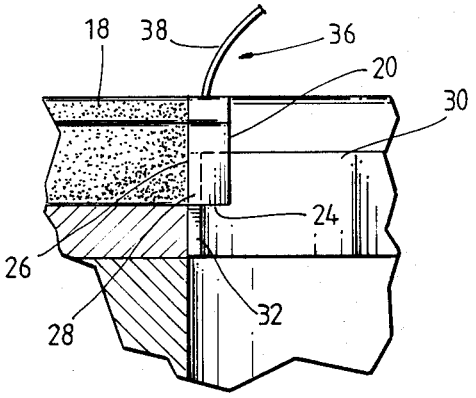

POCKET REDUCER FOR A POCKET BILLIARD TABLE

BACKGROUND OF THE INVENTION

1. Field of the Invention

This invention relates generally to pocket billiard tables, and more particularly, to an apparatus for reducing the size of a billiard table pocket to convert a pocket billiard table into a snooker table or as a practice aid intended to sharpen the skills of pool shooters.

2. Description of the Related Art

In the field of pool table conversion inserts it has commonly been suggested that standard pocket billiard tables may be converted to snooker and billiard tables by the use of plugs which extend the rails at least further into the pocket and sometimes across the pocket.

These devices have typically been of a fairly permanent nature, being attached to the table by drilling and through the use of screws. For example, U.S. Pat. No. 4,010,949, issued Mar. 8, 1977 to Lee discloses the use of a pair of plug assemblies affixed to the ends of the rails adjacent the ball entry portion of the pocket. These plug assemblies, however, are attached to the rails by wood screws extending through the plugs and into the rails themselves. Despite Lee's claims that the plugs are easily installed and easily removed the alteration is more in the nature of a permanent change. While these plugs are admittedly removable, the difficulty of initial installation and the time required for later removal and installation makes this solution undesirable in that it precludes quick and easy conversion between pocket billiards and snooker.

The present invention is directed to overcoming one or more of the problems as set forth above.

SUMMARY OF THE INVENTION

The primary objective of the invention is to provide a pool table pocket reducer which is easily and quickly inserted and removed.

Another objective of the present invention is to provide a pool table pocket reducer which retains proper orientation without being permanently affixed to the pool table.

To attain these and other objectives, an apparatus is provided for use with a pocket billiard table which has a playing field, permanent rail assemblies extending about the periphery of the playing field, and a plurality of pockets disposed about the periphery of the playing field interrupting the permanent rail assemblies. The apparatus includes first and second rail assembly extenders having a lower surface contacting the playing field, an outer surface contacting the interrupted permanent rail assembly, and a ball striking surface substantially similar to the ball striking surface of the permanent rail assembly. An elongate flexible strap has first and second end portions respectively connected to the first and second rail assembly extenders. The first and second end portions extend below the lower surfaces of the first and second rail assembly extenders and contact the outer periphery of the playing field whereby the first and second rail assembly extenders are restricted against displacement onto the playing field. Biasing means urges the first and second rail assembly extenders in directions generally toward the permanent rail assemblies.

BRIEF DESCRIPTION OF THE DRAWINGS

Other objects and advantages of the invention will become apparent upon reading the following detailed description and upon reference to the drawings in which:

FIG. 1 is a perspective view of the instant apparatus positioned within a pocket of a pocket billiard table;

FIG. 2 is a top plan view of the instant apparatus positioned within a pocket of a pocket billiard table; and FIG. 3 is a side view of the instant apparatus positioned within a pocket of a pocket billiard pool table.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Turning now to the drawings and referring simultaneously to FIGS. 1,2, and 3 the apparatus 10 is shown positioned within a pocket 12 of a pocket billiard pool table 14. A playing field 16 is generally constructed of a slate bed which can be, for example, approximately one inch thick covered by a single layer of felt material. The playing field is generally rectangular in configuration with small arcuate sections removed therefrom immediately adjacent each pocket 12. Disposed about the periphery of the playing field 16 is a permanent rail assembly 18 encompassing the entire playing field 16 except for those sections interrupted by the pocket 12. The permanent rail assemblies 18 are, for example, generally constructed of a wood base and resilient cushion covered by a felt material similar to that covering the playing field 16. The cross section of the permanent rail assembly approximates a triangle with one apex of the triangle facing into the playingfield 16 at a height approximating the mid point of playing balls used on the playing field 16.

The pocket 12 is of a generally cylindrical configuration and extends through the permanent rail assemblies 18 and onto the playing field 16 along a pair of parallel lines extending tangentially from the circular pocket 12 at an angle of approximately 45° with the permanent rail assemblies 18. Accordingly, the permanent rail assemblies 18 are cut at an approximate 45° angle at the interface with the pocket 12.

The apparatus 10 includes first and second rail assembly extenders 20, 22 which have a lower surface 24 resting on the playing surface 16. An outer surface 26 of the rail assembly extenders 20, 22 contacts the interrupted permanent rail assembly 18. A ball contacting surface 28 faces outwardly onto the playing surface 16 and is preferably substantially similar in configuration to that of the permanent rail assembly 18. The ball contacting surface 28 and outer surface 26 are preferably formed at an angle of approximately 45° . This angle matches the angle at which the permanent rail assembly 18 is cut by the pocket 12. Accordingly, the ball striking surface 28 forms a substantially identical extension of the permanent rail assembly 18.

An elongate flexible strap 30 has first and second end portions 32, 34 respectively connected to the first and second rail assembly extenders 20, 22. An outer surface of the elongate flexible strap 30 is substantially contiguous wit the outer surface 26 of the rail assembly extenders 20, 22. Accordingly, when the apparatus 10 is placed in the pocket 12, the elongate flexible strap 30 generally conforms itself to the circular configuration of the pocket 12. The outer surface of the rail assembly extenders 20, 22 and the outer surface of the elongate flexible strap 30 are in substantial contact with the outer surface of the pocket 12.

Further, the elongate flexible strap first and second end portions 32, 34 extend below the lower surface 24 of the rail assembly extenders 20, 22 and contact the outer periphery of the playing field 16. It should be appreciated that the rail assembly extenders 20 and 22 are capable of absorbing the force of a ball striking its ball striking surface 28 and rebounding that ball in much the same manner as the permanent rail assembly 18. Accordingly, it is preferable that the rail assembly extenders 20 and 22 have a substantially similar configuration as that of permanent rail assembly 18 as well as be relatively fixed in position.

The vertical height of the rail assembly extenders 20 and 22 is maintained by the lower surface 24 resting on the playing field 16. Further relative displacement into and out of the pocket 12 is controlled by the first and second end portions 32, 34 of the elongate strap 30. For example, the combination of the elongate strap being conformed to the pocket 12 and the first and second end portions 32, 34 of the elongate strap 30 contacting the outer periphery of the playing field 16 effects a relatively stable positioning of the rail assembly extenders 20 and 22. For example, a ball striking the rail assembly extender 20 generates a force tending to move the rail assembly extender 20 in a direction into the pocket 12. This force is transmitted through the elongate strap 30 to the second end portion 34. However, because the second end portion of 34 is contacting the playing field 16, the elongate strap 30 is prevented from moving. Likewise, the rail assembly extender 20 is similarly restricted against movement. Thus, the ball is rebounded in much the same manner as a ball striking the permanent rail assembly 18.

In order to further aid the apparatus 10 in retaining its desired position, a biasing means 36 urges the first and second rail assembly extenders 20, 22 in directions generally toward the permanent rail assembly 18. It is preferable that a relatively tight fit be maintained between the rail assembly extenders 20, 22 and the permanent rail assembly 18.

In the preferred embodiment, the biasing means 36 includes a leaf spring 38 connected to the rail assembly extenders 20, 22 and extending therebetween to form an arc over the ball entry path into the pocket 12. The height of the arc formed by the leaf spring 38 is sufficient to provide clearance for playing balls and to prevent interference with a ball entering the pocket 12. It is envisioned however, that the leaf spring 38 could be replaced by forming the apparatus 10 from a plastic having a stiffer coefficient such that bending the elongate strap 30 to conform to the pocket configuration 12 produces a sufficient springing effect to force the rail assembly extenders 20 and 22 toward the rail assemblies 18. Alternatively, the apparatus 10 could still be formed of a flexible plastic, however, the leaf spring 38 could be formed into the elongate strap 30, thus the spring 38 would extend around the interior of the pocket 12.

Other aspects, objects, and advantages of this invention can be obtained from a study of the drawings, the disclosure, and the appended claims.

What is claimed:

1. An apparatus for use with a pocket billiard table having a playing field, permanent rail assemblies extending about the periphery of the playing field and having a ball striking surface generally directed toward the playing field, and a plurality of pockets disposed about the periphery of the playing field interrupting the permanent rail assemblies, said apparatus, comprising:

first and second rail assembly extenders having a lower surface contacting the playing field, an outer surface contacting the interrupted permanent rail assembly, and a ball striking surface substantially similar to the ball striking surface of the permanent rail assembly;

an elongate flexible strap having first and second end portions respectively connected to the first and second rail assembly extenders, said first and second end portions extending below the lower surfaces of said first and second rail assembly extenders and contacting the outer periphery of the playing field whereby the first and second rail assembly extenders are restricted against displacement onto the playing field; and biasing means for urging the first and second rail assembly extenders in directions generally toward the permanent rail assemblies.

2. An apparatus, as set forth in claim 1, wherein the biasing means includes a leaf spring arcuately extending between and interconnecting the first and second rail assembly extenders.

3. A pocket billiard table having adjustable size pockets, comprising:

a playing field;

a permanent rail assembly extending about the periphery of the playing field and having a ball striking surface generally facing the playing field;

a plurality of pockets disposed about the periphery of the playing field interrupting the permanent rail assemblies;

first and second rail assembly extenders having a lower surface contacting the playing field, an outer surface contacting the interrupted permanent rail assembly, and a ball striking surface substantially similar to the ball striking surface of the permanent rail assembly;

an elongate flexible strap having first and second end portions respectively connected to the first and second rail assembly extenders, said first and second end portions extending below the lower surfaces of said first and second rail assembly extenders and contacting the outer periphery of the playing field whereby the first and second rail assembly extenders are restricted against displacement onto the playing field; and biasing means for urging the first and second rail assembly extenders in directions generally toward the permanent rail assemblies.

4. An apparatus, as set forth in claim 1, wherein the biasing means includes a leaf spring arcuately extending between and interconnecting the first and second rail assembly extenders.

5. A pocket billiard table having adjustable size pockets, comprising:

a playing field;

a permanent rail assembly extending about the periphery of the playing field and having a ball striking surface generally facing the playing field;

a plurality of pockets disposed about the periphery of the playing field interrupting the permanent rail assemblies at a pre-selected angle;

first and second rail assembly extenders having a lower surface contacting the playing field, an outer surface contacting the interrupted permanent rail assembly, and a ball striking surface substantially similar to the ball striking surface of the permanent rail assembly; said outer and ball striking surfaces being formed at said pre-selected angle of the permanent rail assembly;

an elongate flexible strap having first and second end portions respectively connected to the first and second rail assembly extenders, said first and second end portions extending below the lower surfaces of said first and second rail assembly extenders and contacting the outer periphery of the playing field whereby the first and second rail assembly extenders are restricted against displacement onto the playing field; and a leaf spring arcuately extending between and interconnecting the first and second rail assembly extenders whereby the first and second rail assembly extenders are urged in directions generally toward the permanent rail assembly.

* * * * *